US010312589B2

(12) United States Patent
Sayama et al.

(10) Patent No.: US 10,312,589 B2
(45) Date of Patent: Jun. 4, 2019

(54) ANTENNA DIRECTIVITY CONTROL SYSTEM AND RADIO DEVICE

(71) Applicant: AGC Inc., Chiyoda-ku (JP)

(72) Inventors: Toshiki Sayama, Chiyoda-ku (JP); Ryuta Sonoda, Chiyoda-ku (JP); Koji Ikawa, Chiyoda-ku (JP)

(73) Assignee: AGC Inc., Chiyoda-ku (JP)

( * ) Notice: Subject to any disclaimer, the term of this patent is extended or adjusted under 35 U.S.C. 154(b) by 0 days.

(21) Appl. No.: 15/207,849

(22) Filed: Jul. 12, 2016

(65) Prior Publication Data

US 2016/0322702 A1 Nov. 3, 2016

Related U.S. Application Data

(63) Continuation of application No. PCT/JP2015/051017, filed on Jan. 16, 2015.

(30) Foreign Application Priority Data

Jan. 20, 2014 (JP) ..... 2014-008169

(51) Int. Cl.
*H01Q 3/28* (2006.01)
*H01Q 19/26* (2006.01)
(Continued)

(52) U.S. Cl.
CPC ..... *H01Q 3/28* (2013.01); *H01Q 1/243* (2013.01); *H01Q 1/48* (2013.01); *H01Q 19/26* (2013.01); *H01Q 21/28* (2013.01)

(58) Field of Classification Search
CPC ..... H01Q 3/28; H01Q 19/22; H01Q 19/26
See application file for complete search history.

(56) References Cited

U.S. PATENT DOCUMENTS 7,233,289 B2 6/2007 Chung et al.
2002/0044099 A1* 4/2002 Yamamoto ..... H01Q 1/007 343/789
(Continued)

FOREIGN PATENT DOCUMENTS

CN 1496595 A 5/2004
CN 101197465 A 6/2008
(Continued)

OTHER PUBLICATIONS

International Search Report dated Apr. 21, 2015 in PCT/JP2015/051017, filed on Jan. 16, 2015 (with English Translation).
(Continued)

*Primary Examiner* — Daniel Munoz
(74) *Attorney, Agent, or Firm* — Oblon, McClelland, Maier & Neustadt, L.L.P.

(57) ABSTRACT

An antenna directivity control system includes an antenna including a plurality of antenna elements, feeding points for the plurality of antenna elements being mutually different; and a controller for controlling weight for each of the plurality of antenna elements, wherein each of the plurality of antenna elements includes a feed element connected to the feed point, and a radiating element that functions, upon power being fed by establishing electromagnetic field coupling with the feed element, as a radiating conductor, and wherein the controller controls a directivity of the antenna by adjusting an amplitude of a signal at each of the feeding points.

19 Claims, 8 Drawing Sheets

(51) Int. Cl.

| | |
|---|---|
| ***H01Q 21/28*** | (2006.01) |
| ***H01Q 1/24*** | (2006.01) |
| ***H01Q 1/48*** | (2006.01) |

(56) References Cited

U.S. PATENT DOCUMENTS

| | | | | |
|---|---|---|---|---|
| 2004/0066341 | A1* | 4/2004 | Ito | H01Q 1/243 343/702 |
| 2005/0119035 | A1 | 6/2005 | Miyano et al. | |
| 2006/0217075 | A1 | 9/2006 | Sunaga et al. | |
| 2007/0052599 | A1 | 3/2007 | Shimizu et al. | |
| 2008/0143613 | A1* | 6/2008 | Iwai | H01Q 1/243 343/702 |
| 2010/0029332 | A1* | 2/2010 | Fox | H01Q 3/28 455/561 |
| 2012/0268328 | A1 | 10/2012 | Kim et al. | |
| 2013/0271339 | A1 | 10/2013 | Mikata | |
| 2014/0327584 | A1 | 11/2014 | Chang | |
| 2015/0092623 | A1* | 4/2015 | Svendsen | H01Q 13/103 370/278 |

FOREIGN PATENT DOCUMENTS

| | | | |
|---|---|---|---|
| CN | 102480315 | A | 5/2012 |
| JP | 2003-198410 | | 7/2003 |
| JP | 2004-007532 | A | 1/2004 |
| JP | 2006-186600 | | 7/2006 |
| JP | 2006-270730 | | 10/2006 |
| JP | 2011-188385 | | 9/2011 |
| JP | 2013-223125 | | 10/2013 |
| WO | WO 2007/043150 | A1 | 4/2007 |

OTHER PUBLICATIONS

Written Opinion dated Apr. 21, 2015 in PCT/JP2015/051017, filed on Jan. 16, 2015.

Tetsuro Imai et al. "A Propagation Prediction System for Urban Area Macrocells using Ray-tracing Methods", NTT DoCoMo Technical Journal, vol. 6, No. 1, 11 pages.

"3GPP TS 36.213 V10.1.0, 32rd Generation Partnership Project; Technical Specification Group Radio Access Network; Evolved Universal Terrestrial Radio Access (E-UTRA); Physical layer procedures (Release 10)", Technical Specification, 2011, 115 pages.

Andre Kurs et al. "Wireless Power Transfer via Strongly Coupled Magnetic Resonances", Science Express, vol. 317, No. 5834, 2007, 4 pages.

* cited by examiner

ANTENNA DIRECTIVITY CONTROL SYSTEM AND RADIO DEVICE

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2015/051017 filed on Jan. 16, 2015 and designating the U.S., which claims priority of Japanese Patent Application No. 2014-008169 filed on Jan. 20, 2014. The entire contents of the foregoing applications are incorporated herein by reference.

BACKGROUND OF THE INVENTION

1. Field of the Invention

The present invention relates to an antenna directivity control system and a radio device provided with the antenna directivity control system (e.g., a mobile radio terminal, such as a cellular phone).

2. Description of the Related Art

As a method for enhancing communication speed, a MIMO spatial multiplexing communication technique by using a MIMO (Multiple Input Multiple Output) antenna has been utilized. A MIMO antenna is a multi-antenna capable of multiple inputs and multiple outputs at a predetermined frequency by using a plurality of antenna elements. However, for mobile communication, radio wave propagation environments for a terminal are diversified; and, in fact, environments where the MIMO spatial multiplexing communication can be utilized are limited.

For example, Non-Patent Document 1 (Tetsuro Imai, etc., "A Propagation Prediction System for Urban Area Macrocells Using Ray-tracing Methods" NTT DoCoMo Technical Journal, Vol. 6, No. 1, p. 41-51) discloses actually measured data of an angle spread of an incoming wave in an urban area. It shows that, even in an urban area where there are relatively many reflection objects, such as buildings, an angle spread of an incoming wave is less than or equal to 30 degrees, so that a sufficiently rich multi-path environment may not be obtained.

Because of the presence of such a fact, in the 3GPP standard that is indicated as Non-Patent Document 2 (3GPP TS 36.213 V10.1.0 3$^{rd}$ Generation Partnership Project; Technical Specification Group Radio Access Network; Evolved Universal Terrestrial Radio Access (E-UTRA); Physical layer procedures (Release 10), p. 26-27), in addition to the MIMO spatial multiplexing mode, nine transmission modes, such as a beam forming mode, a transmit diversity mode, and a multi-user MIMO mode, are specified in total. A method has been adopted such that a radio wave environment where a terminal is located is measured based on a reference signal that is transmitted from a base station, and a proper transmission mode is selected.

However, since antenna characteristics required for an antenna are different for a case of transmitting by the MIMO spatial multiplexing mode and for a case of transmitting by the beam forming mode, it is difficult to commonize the antenna, so that, currently, these are supported by separate antennas.

There is a need for an antenna directivity control system where different antenna characteristics can be supported by a common antenna.

SUMMARY OF THE INVENTION

According to an aspect of the present invention, there is provided an antenna directivity control system including an antenna including a plurality of antenna elements, feeding points for the plurality of antenna elements being mutually different; and a controller for controlling weight for each of the plurality of antenna elements, wherein each of the plurality of antenna elements includes a feed element connected to the feed point, and a radiating element that functions, upon power being fed by establishing electromagnetic field coupling with the feed element, as a radiating conductor, and wherein the controller controls a directivity of the antenna by adjusting an amplitude of a signal at each of the feeding points.

According to another aspect of the present invention, there is provided a radio device including an antenna directivity control system, wherein the antenna directivity control system includes an antenna including a plurality of antenna elements, feeding points for the plurality of antenna elements being mutually different; and a controller for controlling weight for each of the plurality of antenna elements, wherein each of the plurality of antenna elements includes a feed element connected to the feed point, and a radiating element that functions, upon power being fed by establishing electromagnetic field coupling with the feed element, as a radiating conductor, and wherein the controller controls a directivity of the antenna by adjusting an amplitude of a signal at each of the feeding points.

According to an embodiment, different antenna characteristics can be supported by a common antenna.

Other objects, features and advantages of the present invention will become more apparent from the following detailed description when read in conjunction with the accompanying drawings.

DESCRIPTION OF THE PREFERRED EMBODIMENTS

<Configuration of an Antenna Directivity Control System 10>

Figure 1:
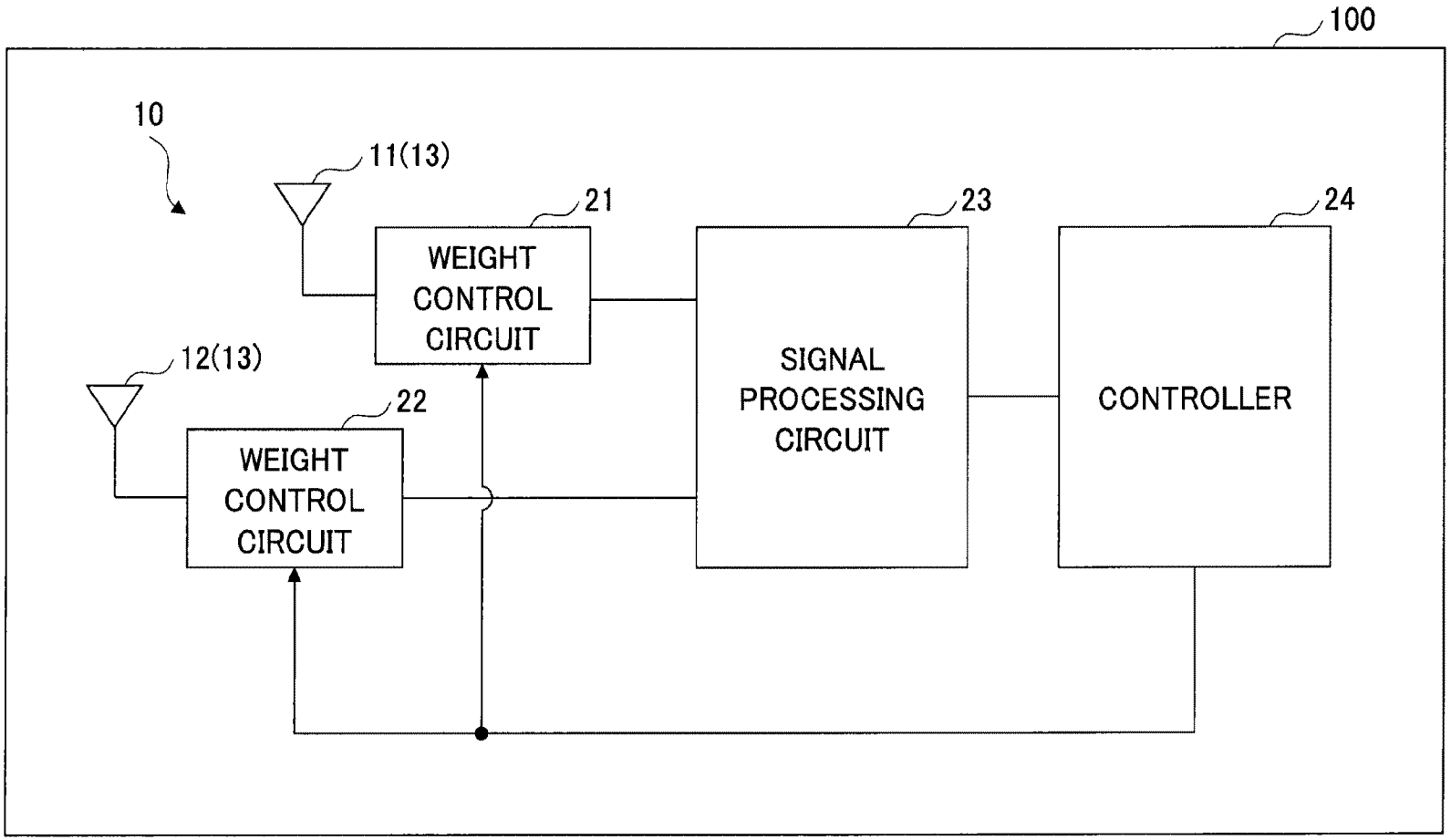
FIG. 1 is a block diagram illustrating an example of a configuration of an antenna directivity control system.

FIG. 1 is a block diagram illustrating a configuration example of an antenna directivity control system 10 according to an embodiment of the present invention. The antenna directivity control system 10 is, for example, an antenna system that is installed in a radio communication device 100. As an example of the radio communication device 100, there is a mobile entity itself or a radio communication device that is installed inside the mobile entity. As examples of the mobile entity, there are a portable mobile terminal device, a vehicle, such as an automobile, a robot, and so forth. As specific examples of the mobile terminal device, there are electronic devices, such as a cellular phone, a smartphone, a tablet type computer, a gaming device, a television, an audio or video player, and so forth.

The antenna directivity control system 10 includes an antenna 13 including a plurality of antenna elements 11 and 12; a signal processing circuit 23; a controller 24; and a plurality of weight control circuits 21 and 22. The antenna elements 11 and 12 are connected to mutually different feeding points.

The two antenna elements 11 and 12 can receive an incoming radio wave (an incoming wave) or transmit a signal of the radio communication device 100; and by adjusting amplitudes of electric currents flowing through the two antenna elements 11 and 12, directivity of the antenna 13 can be controlled.

The signal processing circuit 23 is a circuit that processes a received signal that is obtained by receiving the incoming wave by the antenna elements 11 and 12, or that processes the transmit signal of the radio communication device 100. The signal processing circuit 23 is a circuit that applies, to the received signal obtained by the antenna elements 11 and 12, a high frequency process, such as amplification and AD conversion, or a baseband process, for example.

The controller 24 is an example of a selector for selecting, as a transmission mode to be applied to the antenna 13, a MIMO spatial multiplexing mode or a beam forming mode. The controller 24 outputs, to the weight control circuits 21 and 22, control signals corresponding to the selected transmission mode.

The controller 24 selects, for example, a transmission mode to be applied to the antenna 13, depending on a result of measuring, by the signal processing circuit 23, a radio wave environment in the vicinity of the antenna elements 11 and 12 by using the antenna elements 11 and 12. Upon detecting that a radio wave environment suitable for transmission by the MIMO spatial multiplexing mode is measured, the controller 24 selects the MIMO spatial multiplexing mode, as a transmission mode to be applied to the antenna 13. For the case of the MIMO spatial multiplexing mode, if the antenna 13 includes a plurality of antenna elements, the antenna 13 becomes a MIMO antenna for the plurality of channels. For example, assuming that there are two antenna elements 11 and 12, as illustrated in FIG. 1, the antenna 13 becomes the MIMO antenna for two channels. Whereas, upon detecting that a radio wave environment is suitable for transmission by the beam forming mode, the controller 24 selects the beam forming mode, as the transmission mode to be applied to the antenna 13. For the case of the beam forming mode, the antenna 13 becomes the antenna capable of a directivity control by using the two antenna elements 11 and 12.

The weight control circuits 21 and 22 are an example of a controller for controlling the directivity of the antenna 13 in accordance with a control signal from the controller 24. The weight control circuit 21 and 22 control, for example, the directivity of the antenna 13, which is based on maximum ratio combining of the antenna element 11 and the antenna element 12, by controlling weight, such as amplitudes and phases of the signals received by the antenna elements 11 and 12, respectively, or amplitudes and phases of the signals to be transmitted. In order to control the directivity of the antenna 13, the weight control circuits 21 and 22 adjust, for example, a current value of an electric current that flows through each of the feeding points of the antenna elements 11 and 12.

<Configuration of an Antenna 1>

Figure 2:
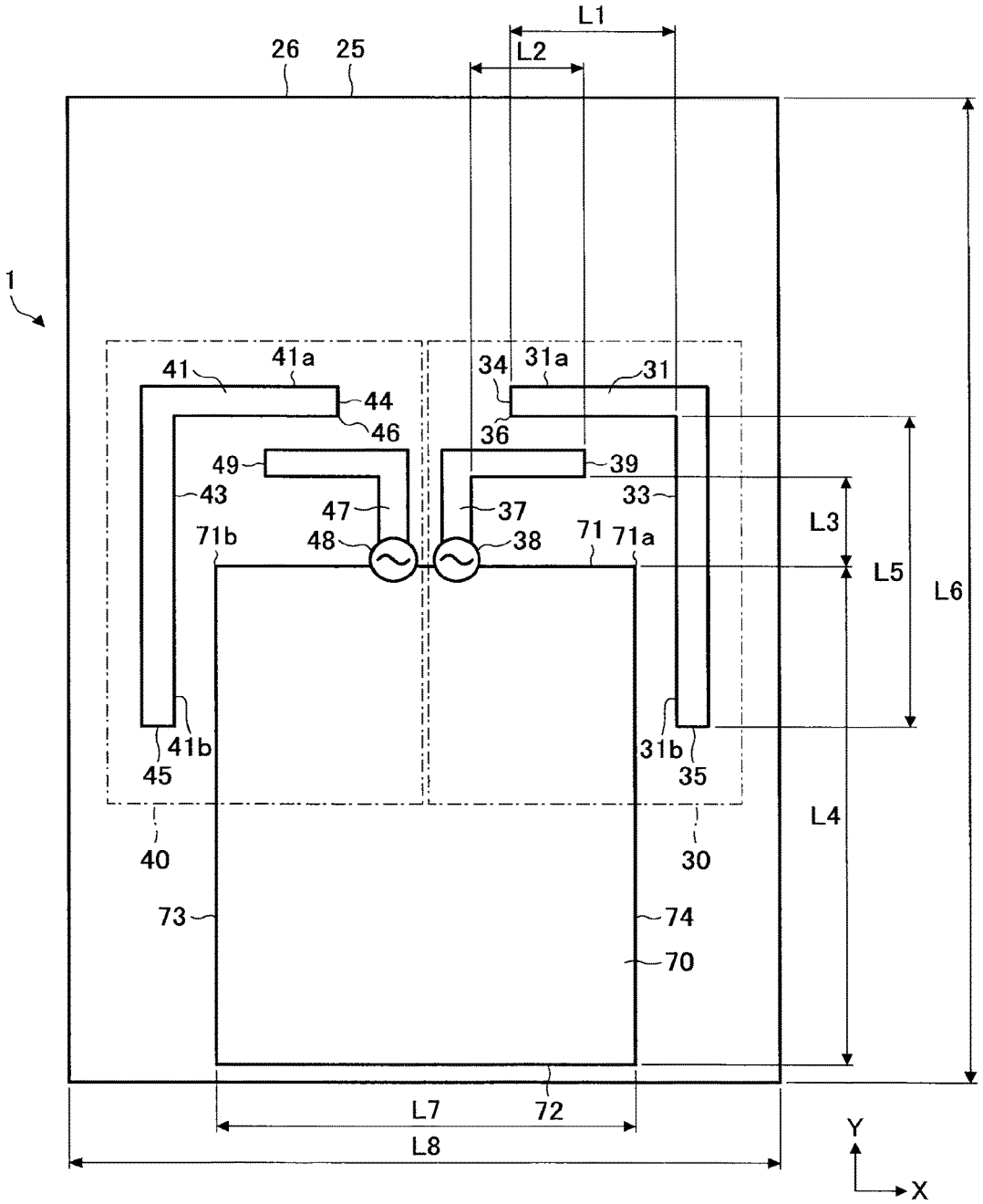
FIG. 2 is a plan view illustrating an example of an antenna including a plurality of antenna elements, where feeding points for the plurality of antenna elements are mutually different.

FIG. 2 is a plan view schematically illustrating an example of a configuration of an antenna 1 according to the embodiment of the present invention. The antenna 1 is an example of the antenna 13 illustrated in FIG. 1. The antenna 1 includes a ground plane 70; an antenna element 30; and an antenna element 40.

The ground plane 70 is a planar conductor pattern; and, in the figure, the ground plane 70 is exemplified that has a rectangular shape extending in the XY-plane. The ground plane 70 includes, for example, outer edge portions 71 and 72 that linearly extend in the X-axis direction; and outer edge portions 73 and 74 that linearly extend in the Y-axis direction. The outer edge portion 72 is the opposite side of the outer edge portion 71; and the outer edge portion 74 is the opposite side of the outer edge portion 73. The ground plane 70 is arranged, for example, parallel to the XY-plane; and the ground plane 70 has a rectangular outer shape with a lateral length of L7, which is parallel to the X-axis direction, and a vertical length of L4, which is parallel to the Y-axis direction. The ground plane 70 is laminated on a substrate 25 (cf., FIG. 3); the ground plane 70 may be installed on a surface layer (outer layer) of the substrate 25, or the ground plate 70 may be installed on an inner layer of the substrate 25. The ground plane 70 is a ground part with a ground potential. It is preferable that the ground plane 70 be a ground portion with an area that is greater than or equal to a predetermined value, so that impedance matching of the antenna can be easily achieved; however, the ground plane 70 may be a ground part to which components implemented on the substrate 25, such as a capacitor, are electrically connected.

The antenna elements 30 and 40 are connected to mutually different feeding points. The antenna element 30 is connected to a feeding point 38 with a ground end, which is the outer edge portion 71; and the antenna element 40 is connected to a feeding point 48 with a ground end, which is the outer edge portion 71, and which is the same as that of the feeding point 38. The ground plane 70 is a ground reference that is in common with the feeding point 38 and the feeding point 48.

The feeding point 38 and the feeding point 48 are arranged in close proximity to each other. The feeding point 38 is installed at a position closer to the feeding point 48, compared to one end 71*a* of the outer edge portion 71 in the X-axis direction (for the depicted case, an intersection point between the outer edge portion 71 and the outer edge portion 74). The feeding point 48 is installed at a position closer to the feeding point 38, compared to the other end 71*b* of the outer edge portion 71 in the X-axis direction (for the depicted case, an intersection point between the outer edge portion 71 and the outer edge portion 73). Since the feeding point 38 and the feeding point 48 are arranged in close proximity to each other, strip conductors that are connected to the feeding point 38 and the feeding point 48 can be approximated to each other, so that a space required for installing the antenna elements 30 and 40 can be easily reduced.

The antenna element 30 is an example of an antenna element with a feed element 37 and a radiating element 31; and the antenna element 40 is an example of an antenna element with a feed element 47 and a radiating element 41.

It is preferable that the shapes of the antenna element 30 and the antenna element 40 be line symmetric with respect to an axis of symmetry that is a straight line parallel to the Y-axis (line symmetric with respect to the YZ-plane that passes through between the feeding point 38 and the feeding point 48), so that the directivity of the antenna 1 can be easily controlled. If these are line symmetric, the total length of the feed element 37 is equal to the total length of the feed element 47; and the total length of the radiating element 31 is equal to the total length of the radiating element 41.

The feed element 37 is an example of a feed element connected to the feeding point 38 for which the ground plane 70 is the ground reference. The feed element 37 is a line shaped conductor that can feed power by being contactlessly coupled to the radiating element 31 in a high-frequency coupling. In the figure, the feed element 37 is exemplified, which is formed to have an L-shape by a linear conductor that extends in a direction perpendicular to the outer edge portion 71 and parallel to the Y-axis; and by a linear conductor that extends by running in parallel with the outer edge portion 71, which is parallel to the X-axis. For the depicted case, the feed element 37 extends in the Y-axis direction from the feeding point 38, as a starting point; and then the feed element 37 is bent in the X-axis direction, and extends in the X-axis direction until an end portion 39 of the extension in the X-axis direction. The end portion 39 is an open end to which no other conductor is connected. The feed element 37 is not limited to the depicted shape.

The feeding point 38 is a feeding part that is to be connected to a predetermined transmission line or a feeder line that utilizes the ground plane 70. As specific examples of the predetermined transmission line, there are a microstripline, a strip line, a coplanar waveguide with a ground plane (a coplanar waveguide where the ground plane is installed on a surface that is opposite to a conductor surface), and so forth. As the feeder line, there are feeder wire and a coaxial cable.

The radiating element 31 is arranged to be separated from the feed element 37; and the radiating element 31 is an example of a radiating element that functions, upon power being fed by establishing electromagnetic field coupling with the feed element 37, as a radiating conductor. The radiating element 31 is a linear conductor with a feeding part 36 at which power is contactlessly fed from the feed element 37.

In the figure, the radiating element 31 is exemplified, which is formed to have an L-shape. The L-shaped radiating element 31 includes a conductor portion 31*a* that is arranged to be separated from the outer edge portion 71 and that extends in the X-axis direction to follow the outer edge portion 71; and a conductor portion 31*b* that is arranged to be separated from the outer edge portion 74 and that extends in the Y-axis direction to follow the outer edge portion 74. In the figure, the L-shaped radiating element 31 is exemplified; however, the shape of the radiating element 31 may be another shape, such as a single straight-line shape or a meander shape.

By including, in the radiating element 31, the conductor portion 31*a* along the outer edge portion 71, or by including, in the radiating element 31, the conductor portion 31*b* along the outer edge portion 74, the directivity of the antenna element 30 can be easily adjusted, for example.

Further, by extending the conductor portion 31*a* in the X-axis direction so as to intersect the Y-axis direction in which the conductor portion 41*b* extends, the directivity of the antenna 1 can be easily controlled, for example. Similarly, by extending the conductor portion 31*b* in the Y-axis direction so as to intersect the X-axis direction in which the conductor portion 41*a* extends, the directivity of the antenna 1 can be easily controlled, for example.

Since the ground plane 70 that is used in common by the feeding point 38 and the feeding point 48 is located between the conductor portion 31*b* of the radiating element 31 and the conductor portion 41*b* of the radiating element 41, the directivity of the antenna 1 can be easily controlled, for example.

The radiating element 31 and the feed element 37 may be overlapped or may not be overlapped in a plan view in any direction, such as the X-axis direction, the Y-axis direction, or the Z-axis direction, as long as the feed element 37 is separated from the radiating element 31 by a distance with which electromagnetic field coupling can be established, so that the feed element 37 can contactlessly feed power to the radiating element 31.

The feed element 37 and the radiating element 31 are arranged to be separated by a distance with which they can mutually establish electromagnetic field coupling. The radiating element 31 includes the feeding part 36 at which power is fed from the feed element 37. The radiating element 31 is contactlessly fed power at the feeding part 36 through the feed element 37 by electromagnetic field coupling. By being fed power in this manner, the radiating element 31 functions as a radiating conductor of the antenna element 30.

As depicted, if the radiating element 31 is a linear conductor connecting the two points, a resonance current (distribution) similar to that of a half-wavelength dipole antenna is formed on the radiating element 31. Namely, the radiating element 31 functions as a dipole antenna (which is referred to as a "dipole mode," hereinafter) that resonates at a half-wavelength of a predetermined frequency.

The electromagnetic field coupling is coupling that utilizes a resonance phenomenon of an electromagnetic field; and the electromagnetic field coupling is disclosed, for example, in a non-patent document (A. Kurs, et al, "Wireless Power Transfer via Strongly Coupled Magnetic Resonances," Science Express, Vol. 317, No. 5834, pp. 83-86, July 2007). The electromagnetic field coupling is also referred to as electromagnetic field resonant coupling or electromagnetic field resonance coupling; and the electromagnetic field coupling is a technique for transmitting energy, by placing resonators that resonate at the same frequency in close proximity to each other, and by causing one of the resonators to be resonated, to the other resonator through coupling in a near field (a non-radiation field area) that is formed between the resonators. Additionally, the electromagnetic field coupling means coupling by an electric field and a magnetic field at a high frequency excluding capacitive coupling and coupling by electromagnetic induction. Here, "excluding capacitive coupling and coupling by electromagnetic induction" does not mean that all of these couplings disappear, and it implies that these couplings are so small to the extent that no effect is caused. A medium between the feed element 37 and the radiating element 31 may be the air, or a dielectric, such as a glass and a resin.

Note that it is preferable not to place a conductive material, such as a ground plane or a display, between the feed element 37 and the radiating element 31.

By establishing the electromagnetic field coupling between the feed element 37 and the radiating element 31, a structure that is robust against impact can be obtained. Namely, by using the electromagnetic field coupling, power can be fed to the radiating element 31 by using the feed element 37 without physically contacting the feed element 37 and the radiating element 31, so that the structure can be obtained that is robust against the impact, compared to a contact power feeding method with which a physical contact is required.

By establishing the electromagnetic field coupling between the feed element 37 and the radiating element 31, contactless power feeding can be implemented with a simple structure. Namely, by using the electromagnetic field coupling, power can be fed to the radiating element 31 by using the feed element 37 without physically contacting the feed element 37 and the radiating element 31, so that power feeding can be achieved with the simple structure, compared to the contact power feeding method with which a physical contact is required. Additionally, by using the electromagnetic field coupling, power can be fed to the radiating element 31 by using the feed element 37 without including a redundant component, such as a capacitor plate, so that power feeding can be achieved with the simple structure, compared to a case where power is fed by capacitive coupling.

Furthermore, even if clearance (a coupling distance) between the feed element 37 and the radiating element 31 is increased, a total efficiency (an antenna gain) of the radiating element 31 tends not to be lowered for a case where power is fed by electromagnetic field coupling, compared to a case where power is fed by capacitive coupling or by magnetic field coupling. Here, the total efficiency is a quantity that is calculated as a product of radiation efficiency and a return loss of an antenna; and the total efficiency is a quantity that is defined as antenna efficiency with respect to input power. Thus, by establishing electromagnetic coupling between the feed element 37 and the radiating element 31, degrees of freedom of determining installation positions of the feed element 37 and the radiating element 31 can be increased, whereby positional robustness can be enhanced. Note that high positional robustness means that even if the installation positions of the feed element 37 and the radiating element 31 are shifted, an effect that is caused to the total efficiency of the radiating element 31 is small. It is also advantageous in a point that, since the degrees of freedom of determining the installation positions of the feed element 37 and the radiating element 31 are large, a space required for installing the antenna element 30 can be easily reduced.

Further, for the depicted case, the feeding part 36 that is a part at which the feed element 37 feeds power to the radiating element 31 is located at a part other than a center portion 33 between one end portion 34 and the other end portion 35 of the radiating element 31 (the part between the center portion 33 and the end portion 34 or the end portion 35). In this manner, by locating the feeding part 36 at the part of the radiating element 31 other than the part with the lowest impedance at the resonance frequency of a fundamental mode of the radiating element 31 (the center portion 33 in this case), matching of the antenna element 30 can be easily achieved. The feeding part 36 is defined to be the part, which is closest to the feeding point 38, of the conductor part of the radiating element 31 where the radiating element 31 and the feed element 37 are the closest to each other.

The impedance of the radiating element 31 increases, as a position separates from the center portion 33 of the radiating element 31 toward the end portion 34 or the end portion 35. For a case of high impedance coupling of the electromagnetic field coupling, even if the impedance between the feed element 37 and the radiating element 31 is slightly changed, an effect caused to the impedance matching is small, as long as the coupling with the impedance that is greater than or equal to a certain level is maintained. Thus, the feeding part 36 of the radiating element 31 is preferably located at a high-impedance portion of the radiating element 31, so that the matching can be easily achieved.

For example, in order to easily achieve impedance matching of the antenna element 30, the feeding part 36 can be located at a portion that is separated from the portion with the lowest impedance at the resonance frequency of the fundamental mode of the radiating element 31 (the center portion 33, in this case) by a distance that is greater than or equal to ⅛ of the entire length of the radiating element 31 (preferably greater than or equal to ⅙; and more preferably greater than or equal to ¼). For the depicted case, the entire length of the radiating element 31 corresponds to L1+L5; and the feeding part 36 is located at the side of the end portion 34 with respect to the center portion 33.

Further, for a case where the wavelength of the radio wave at the resonance frequency of the fundamental mode of the radiating element 31 in vacuum is $\lambda_0$, the shortest distance D1 between the feeding part 36 and the ground plane 70 is greater than or equal to $0.0034\lambda_0$ and less than or equal to $0.21\lambda_0$. The shortest distance D1 is more preferably greater than or equal to $0.0043\lambda_0$ and less than or equal to $0.199\lambda_0$, and further more preferably greater than or equal to $0.0069\lambda_0$ and less than or equal to $0.164\lambda_0$. It is advantageous to set the shortest distance D1 to be within such a range in a point to enhance the total efficiency of the radiating element 31. Furthermore, since the shortest distance D1 is less than ($\lambda_0/4$), the antenna element 30 generates a linearly polarized wave, instead of generating circularly polarized wave.

Note that the shortest distance D1 corresponds to the distance of a straight line connecting the closest portions of the feeding part 36 and the outer edge portion 71; and the outer edge portion 71 for this case is the outer edge portion of the ground plane 70 that is the reference of the ground of the feeding point 38, which is connected to the feed element 37 for feeding power to the feeding part 36. Additionally, the radiating element 31 and the ground plane 70 may be on the same plane, or on different planes. Furthermore, the radiating element 31 may be installed on a plane that is parallel to a plane on which the ground plane 70 is installed; or the radiating element 31 may be installed on a plane that intersects the plane on which the feed element 37 in installed at any angle.

Furthermore, for a case where a wavelength of a radio wave at the resonance frequency of the fundamental mode of the radiating element 31 in vacuum is $\lambda_0$, the shortest distance D2 between the feed element 37 and the radiating element 31 is preferably less than or equal to $0.2\times\lambda_0$ (more preferably less than or equal to $0.1\times\lambda_0$, and further more preferably less than or equal to $0.05\times\lambda_0$). It is advantageous to install the feed element 37 and the radiating element 31 to be separated by the shortest distance D2 in a point to enhance the total efficiency of the radiating element 31.

Note that the shortest distance D2 corresponds to the distance of a straight line connecting the closest portions of the feeding part 36 and the feed element 37 for feeding power to the feeding part 36. Further, when the feed element 37 and the radiating element 31 are viewed in any direction, the feed element 37 may or may not intersect the radiating element 31, and the angle of the intersection may be any angle, as long as electromagnetic coupling is established between them. Additionally, the radiating element 31 and the feed element 37 may be on the same plane, or on different planes. Furthermore, the radiating element 31 may be installed on a plane that is parallel to a plane on which the feed element 37 is installed; or the radiating element 31 may be installed on a plane that intersects the plane on which the feed element 37 in installed at any angle.

Additionally, a distance with which the feed element 37 and the radiating element 31 are extended in parallel while separated by the shortest distance D2 is preferably less than or equal to ⅜ of the physical length of the radiating element 31. It is more preferably less than or equal to ¼, and further more preferably less than or equal to ⅛.

The position of the shortest distance D2 is the portion where the coupling between the feed element 37 and the radiating element 31 is strong, so that, if the distance with which the feed element 37 and the radiating element 31 are extended in parallel while separated by the shortest distance D2 is long, strong coupling is made at a high impedance portion and a low impedance portion of the radiating element 31, and impedance matching may not be achieved. Thus, it is advantageous, in a point of impedance matching, that the distance with which these are extended in parallel while separated by the shortest distance D2 is short, so that strong coupling is made only at a portion of the radiating element 31 where a variation of the impedance is small.

Furthermore, assuming that an electrical length that induces the fundamental mode of the resonance of the feed element 37 is Le37, an electrical length that induces the fundamental mode of the resonance of the radiating element 31 is Le31, and the wavelength on the feed element 37 or the radiating element 31 at the resonance frequency $f_1$ of the fundamental mode of the radiating element 31 is λ, it is preferable that Le37 be less than or equal to (⅜)·λ; and that Le31 be greater than or equal to (⅜)·λ and less than or equal to (⅝)·λ.

Additionally, since the ground plane 70 is formed in such a manner that the outer edge portion 71 follows the radiating element 31, the feed element 37 can form, by the interaction with the outer edge portion 71, a resonance current (distribution) on the feed element 37 and the ground plane 70, and the feed element 37 resonates with the radiating element 31 to establish the electromagnetic field coupling. Thus, there is no specific lower limit value for the electrical length Le37 of the feed element 37, and the electrical length Le37 may be a length with which the feed element 37 can physically establish electromagnetic field coupling with the radiating element 31.

Additionally, if it is desirable to add a degree of freedom to the shape of the feed element 37, Le37 is more preferably greater than or equal to (⅛)·λ and less than or equal to (⅜)·λ, and especially preferably greater than or equal to (3/16)·λ and less than or equal to (5/16)·λ. It is preferable that Le37 be within this range because the feed element 37 favorably resonates at a design frequency (the resonance frequency $f_1$) of the radiating element 31, and consequently the feed element 37 and the radiating element 31 resonate without depending on the ground plane 70, so that favorable electromagnetic field coupling can be obtained.

Here, the fact that electromagnetic field coupling is established implies that matching is achieved. Further, in this case, it is not necessary to design the electrical length of the feed element 37 to adjust to the resonance frequency f of the radiating element 31, and the feed element 37 can be freely designed as a radiation conductor, so that the antenna element 30 to support multi-frequency can be easily achieved.

Note that, for a case where, for example, a matching circuit is not included, the physical length L37 (which corresponds to L2+L3 for the depicted case) of the feed element 37 is determined by $\lambda_{g1}=\lambda_0 \cdot k_1$, where $\lambda_0$ is the wavelength of the radio wave at the resonance frequency of the fundamental mode of the radiating element in vacuum, and $k_1$ is a shortening coefficient of a wavelength shortening effect caused by an environment of implementation. Here, $k_1$ is a value that is calculated from a relative dielectric constant, relative permeability, thickness, a resonance frequency, and so forth of a medium (an environment) of, for example, a dielectric substrate, in which the feed element is installed, such as an effective dielectric constant ($\varepsilon_{r1}$) and effective relative permeability ($\mu_{r1}$) of an environment of the feed element 37. Namely, L37 is less than or equal to $(3/8)\cdot\lambda_{g1}$. Note that the shortening coefficient may be calculated from the above-described physical properties, or the shortening coefficient may be obtained by actual measurement. For example, a resonance frequency is measured for a target element installed in an environment for which a shortening coefficient is to be measured, and a resonance frequency is measured for the same element in an environment where a shortening coefficient for each of frequencies is known. Then, the shortening coefficient may be calculated from the difference between these resonance frequencies.

The physical length L37 of the feed element 37 is a physical length providing Le37, and, for an ideal case where no other elements are included, L37 is equal to Le37. For a case where the feed element 37 includes a matching circuit, L37 is preferably greater than zero and less than or equal to Le37. L37 can be shortened (the size is reduced) by using a matching circuit, such as an inductor.

Further, the fundamental mode of the resonance of the radiating element 31 is the dipole mode (a linear conductor such that both ends of the radiating element 31 are open ends); and Le31 is preferably greater than or equal to (⅜)·λ and less than or equal to (⅝)·λ; more preferably greater than or equal to (7/16)·λ and less than or equal to (9/16)·λ; and especially preferably greater than or equal to (15/32)·λ and less than or equal to (17/32)·λ. Additionally, when higher-order modes are considered, Le31 is preferably greater than or equal to (⅜)·λ·m and less than or equal to (⅝)·λ·m; more preferably greater than or equal to (7/16)·λ·m and less than or equal to (9/16)·λ·m; and especially preferably greater than or equal to (15/32)·λ·m and less than or equal to (17/32)·λ·m. Note that m is a mode number of the higher-order mode, and it is a natural number. It is preferable that m be an integer from 1 to 5; and it is particularly preferable that it be an integer from 1 to 3. The case where m=1 is the fundamental mode. It is preferable that L31 be within this range because the radiating element 31 sufficiently functions as a radiation conductor, and the antenna efficiency is favorable.

Note that the physical length L31 of the radiating element 31 is determined by $\lambda_{g2}=\lambda_0 \cdot k_2$, where $\lambda_0$ is the wavelength of the radio wave at the resonance frequency of the fundamental mode of the radiating element in vacuum, and $k_2$ is a shortening coefficient of a wavelength shortening effect caused by an environment of implementation. Here, $k_2$ is a value that is calculated from a relative dielectric constant, relative permeability, thickness, a resonance frequency, and so forth of a medium (an environment) of, for example, a dielectric substrate, in which the radiating element is installed, such as an effective dielectric constant ($\varepsilon_{r2}$) and effective relative permeability ($\mu_{r2}$) of an environment of the radiating element 31. Namely, L31 is ideally $(1/2)\cdot\lambda_{g2}$. The length L31 of the radiating element 31 is preferably greater than or equal to $(1/4)\cdot\lambda_{g2}$ and less than or equal to $(3/4)\cdot\lambda_{g2}$, and more preferably greater than or equal to $(3/8)\cdot\lambda_{g2}$ and less than or equal to $(5/8)\cdot\lambda_{g2}$.

A physical length L31 of the radiating element 31 is a physical length providing Le31, and, for an ideal case where no other elements are included, L31 is equal to Le31. Even if L31 is shortened by using a matching circuit, such as an inductor, L31 is preferably greater than zero and less than or equal to Le31, and particularly preferably greater than or equal to 0.4 times Le31 and less than or equal to 1 times Le31. It is advantageous to adjust the length L31 of the radiating element 31 to be such a length in a point to enhance the total efficiency of the radiating element 31.

Additionally, as depicted, for a case where the interaction between the feed element 37 and the outer edge portion 71 of the ground plane 70 can be used, the feed element 37 may be caused to function as a radiating conductor. The radiating element 31 is a radiating conductor that functions, upon power being contactlessly fed at the feeding part 36 by the feed element 37 through electromagnetic field coupling, as a $\lambda/2$ dipole antenna, for example. Whereas, the feed element 37 is a linear feed conductor capable of feeding power to the radiating element 31; however, the feed element 37 is a radiating conductor that can function, upon power being fed at the feeding point 38, as a monopole antenna (e.g., a $\lambda/4$ monopole antenna). By setting the resonance frequency of the radiating element to be $f_1$ and the resonance frequency of the feed element 37 to be $f_2$, and by adjusting the length of the feed element 37, so that the feed element 37 is a monopole antenna that resonates at the frequency $f_2$, the radiation function of the feed element can be utilized, whereby the antenna element 30 to support multi-frequency can be easily achieved.

Note that, for a case where, for example, a matching circuit is not included, the physical length L37 of the feed element 37 for the case of using the radiation function is determined by $\lambda_{g3}=\lambda_1\cdot k_1$, where $\lambda_1$ is the wavelength of the radio wave at the resonance frequency $f_2$ of the feed element 37 in vacuum, and $k_1$ is a shortening coefficient of a wavelength shortening effect caused by an environment of implementation. Here, $k_1$ is a value that is calculated from a relative dielectric constant, relative permeability, thickness, a resonance frequency, and so forth of a medium (an environment) of, for example, a dielectric substrate, in which the feed element is installed, such as an effective dielectric constant ($\varepsilon_{r1}$) and effective relative permeability ($\mu_{r1}$) of an environment of the feed element 37. Namely, L37 is greater than or equal to $(1/8)\cdot\lambda_{g3}$ and less than or equal to $(3/8)\cdot\lambda_{g3}$, and preferably greater than or equal to $(3/16)\cdot\lambda_{g3}$ and less than or equal to $(5/16)\cdot\lambda_{g3}$.

Here, power may be fed to a plurality of radiating elements from the single feed element 37. By using the plurality of radiating elements, it can be facilitated to achieve multi-band, wide-band, directivity control, and so forth. Furthermore, a plurality of antennas 1 may be installed in a single radio communication device.

Since the antenna element 40 has a structure that is the same as that of the antenna element 30, for the description of the antenna element 40, a reference is made to the description of the antenna element 30.

Figure 3:
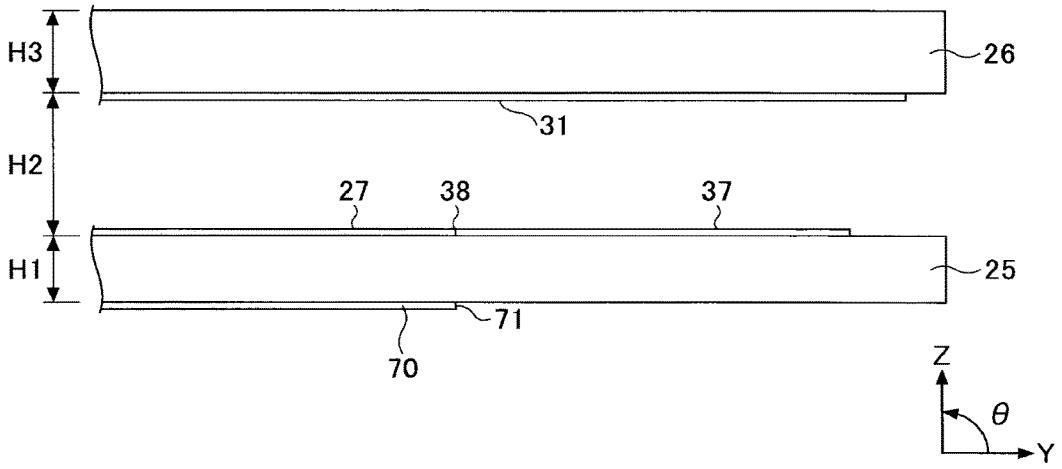
FIG. 3 is a diagram illustrating an example of a positional relationship among components of the antenna.

FIG. 3 is a diagram schematically illustrating a positional relationship (positional relationship in the height direction that is parallel to the Z-axis) of each of the components of the antenna 1 in the Z-axis direction. At least two of the feed element 37, the radiating element 31, and the ground plate 70 may be conductors with portions that are arranged at different heights from each other, or may be conductors with portions that are arranged at the same height.

The feed element 37 is installed on the surface of the substrate 25 facing the radiating element 31. However, the feed element 37 may be installed on the surface of the substrate 25 that is opposite to the side facing the radiating element 31, may be installed on a lateral surface of the substrate 25, may be installed inside the substrate 25, or may be installed in a member other than the substrate 25.

The ground plane 70 is installed on the surface of the substrate 25 that is opposite to the side facing the radiating element 31. However, the ground plane 70 may be installed on the surface of the substrate 25 facing the radiating element 31, may be installed on a lateral surface of the substrate 25, may be installed inside the substrate 25, or may be installed in a member other than the substrate 25.

The substrate 25 includes the feed element 37; the feeding point 38, and the ground plane 70 that is the reference of the ground of the feed point 38. Additionally, the substrate 25 includes a transmission line including a strip conductor 27 to be connected to the feeding point 38. The strip conductor 27 is, for example, a signal line formed on the surface of the substrate 25, so that substrate 25 is disposed between the strip conductor 27 and the ground plane 70.

The radiating element 31 is arranged to be separated from the feed element 37; and, as depicted, the radiating element 31 is installed on the substrate 26 facing the substrate 25, while the radiating element 31 is separated from the substrate 25 by a distance of H2, for example. The radiating element 31 is installed on the surface of the substrate 26 facing the feed element 37. However, the radiating element 31 may be installed on the surface of the substrate 26 opposite to the side facing the feed element 37, may be installed on a lateral surface of the substrate 26, or may be installed in a member other than the substrate 26.

The substrate 25 or the substrate 26 is arranged, for example, to be parallel to the XY-plane; and the substrate 25 or the substrate 26 is a substrate with a base material, which is dielectric, a magnetic material, or a mixture of dielectric and a magnetic material. As specific examples of the dielectric, there are a resin, glass-ceramics, LTCC (Low Temperature Co-Fired Ceramics), alumina, and so forth. As a specific example of the mixture of the dielectric and the magnetic material, it suffices if the mixture includes at least one of transition elements, such as Fe, Ni, and Co, metals including rare earth elements, such as Sm and Nd, and an oxide; and there are, for example, hexagonal ferrite, spinnel ferrite (e.g., Mn—Zn type ferrite, and Ni—Zn type ferrite)), garnet-based ferrite, permalloy, sendust (registered trademark), and so forth.

For example, for a case where the antenna 1 is to be installed in a mobile radio device with a display, the substrate 26 may be, for example, a cover glass that entirely covers an image display surface of the display; or the substrate 26 may be a casing (in particular, a bottom surface or a lateral surface, etc.) to which the substrate 25 is fixed. The cover glass is a dielectric substrate that is transparent, or semitransparent to the extent that a user can visually recognize an image displayed on the display; and the cover glass is a flat-plate like member that is laminated and installed on the display.

For a case where the radiating element 31 is installed on the surface of the cover glass, the radiating element 31 may be formed by spreading conductive paste, such as copper and silver, on the surface of the cover glass, and by sintering it. As the conductor paste for this case, conductor paste that can be sintered at a low temperature may be used, which can be sintered at a temperature at which strengthening of the chemically strengthened glass used for the cover glass is not to be weakened. Additionally, to prevent deterioration of the conductor due to oxidation, plating may be applied to it. Furthermore, decorative printing may be made on the cover glass; and the conductor may be formed on the portion where the decorative printing is made. Further, for a case where a black shielding film is formed at a periphery of the cover glass, for example, to hide wiring, the radiating element 31 may be formed on the black shielding film.

For the MIMO spatial multiplexing mode, it is preferable that the correlation coefficient between antennas be small. Note that, for the MIMO spatial multiplexing mode, it may not be true that it is better that the correlation coefficient is as small as possible, and it suffices if the correlation coefficient is smaller than a certain correlation coefficient because favorable communication can be ensured under an environment where sufficient multipath can be obtained.

The antenna 1 of FIG. 2 has an antenna characteristic such that the correlation coefficient between the antenna element 30 and the antenna element 40 becomes small at the resonance frequency. The reason is that, even if the antenna element 30 and the antenna element 40 are in close proximity to each other, electromagnetic field coupling is established between the feed element 37 and the radiating element 31, and electromagnetic field coupling is established between the feed element 47 and the radiating element 41.

Figure 4:
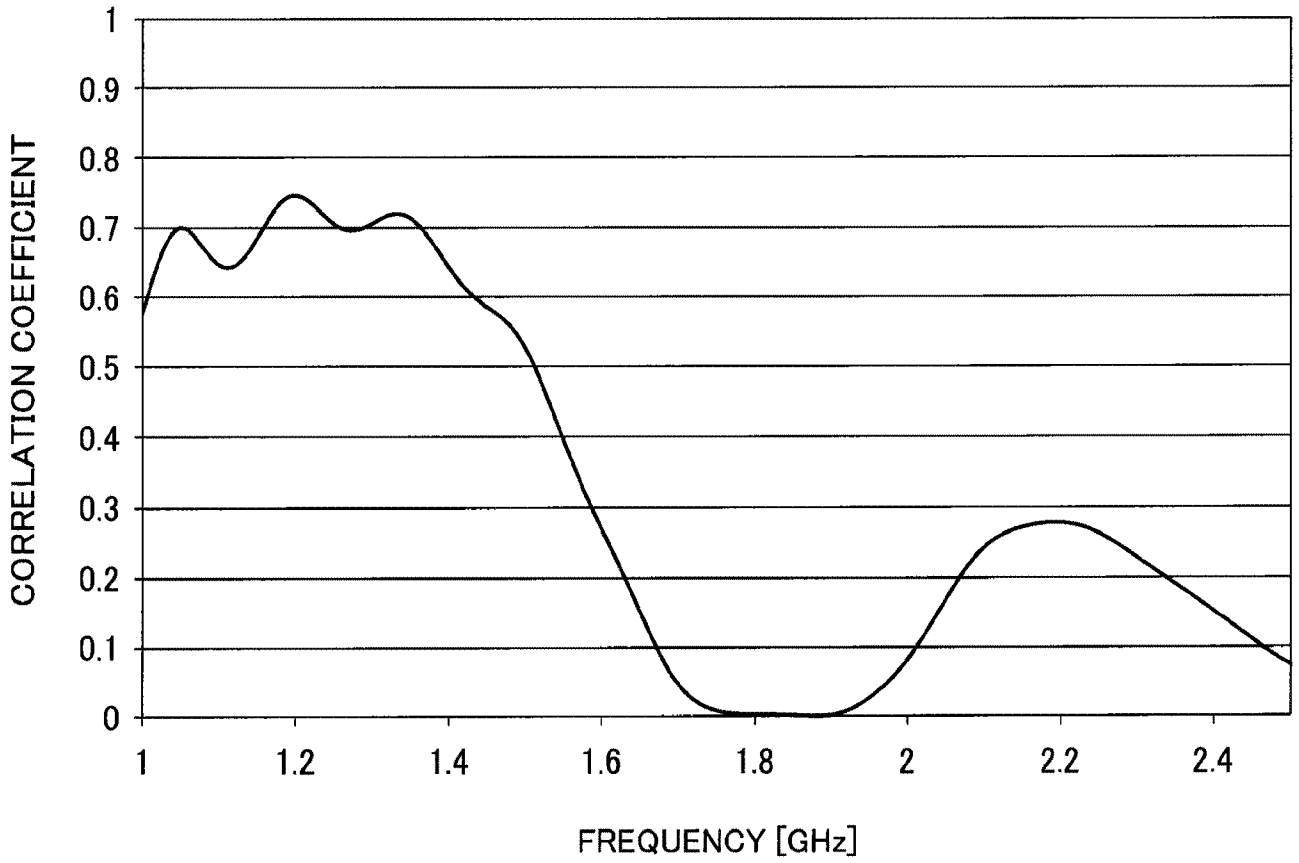
FIG. 4 is a characteristic diagram illustrating an example of a simulation result of a correlation coefficient of the antenna.

For example, for a case where it is designed so that the resonance frequency of the fundamental mode of the antenna 1 is in the vicinity of 1.8 GHz, the characteristic diagram, such as that of illustrated in FIG. 4, is obtained. FIG. 4 is a diagram showing, for the antenna 1 that is designed so that the resonance frequency of the fundamental mode is in the vicinity of 1.8 GHz, a relationship between the correlation coefficient between the antenna element 30 and the antenna element 40 and the frequency. The correlation coefficient is calculated in accordance with the following expression, from the S parameter for a case where the feeding point 38 is the antenna port 1, and the feeding point 48 is the antenna port 2.

correlation coefficient = [Expression 1]

$$\frac{|S_{11} * S_{12} + S_{21} * S_{22}|^2}{(1 - (|S_{11}|^2 + |S_{21}|^2))(1 - (|S_{22}|^2 + |S_{12}|^2))}$$

As it is apparent from FIG. 4, the correlation coefficient between the antenna element 30 and the antenna element 40 is decreased close to zero in the vicinity of the resonance frequency of 1.8 GHz. A similar result can be obtained for a case where the antenna 1 is designed so that the resonance frequency matches another frequency included in the UHF band or the SHF band.

Whereas, since the beam forming mode is a scheme such that the same information is simultaneously transmitted by the plurality of antenna elements, while directing the directivity in the maximum gain direction, it is preferable that the maximum value of a combined gain of the plurality of antenna elements be large. Thus, if the direction of the maximum combined gain of the plurality of antenna elements can be varied, a directivity pattern suitable for transmission by the beam forming mode can be formed.

Figure 5:
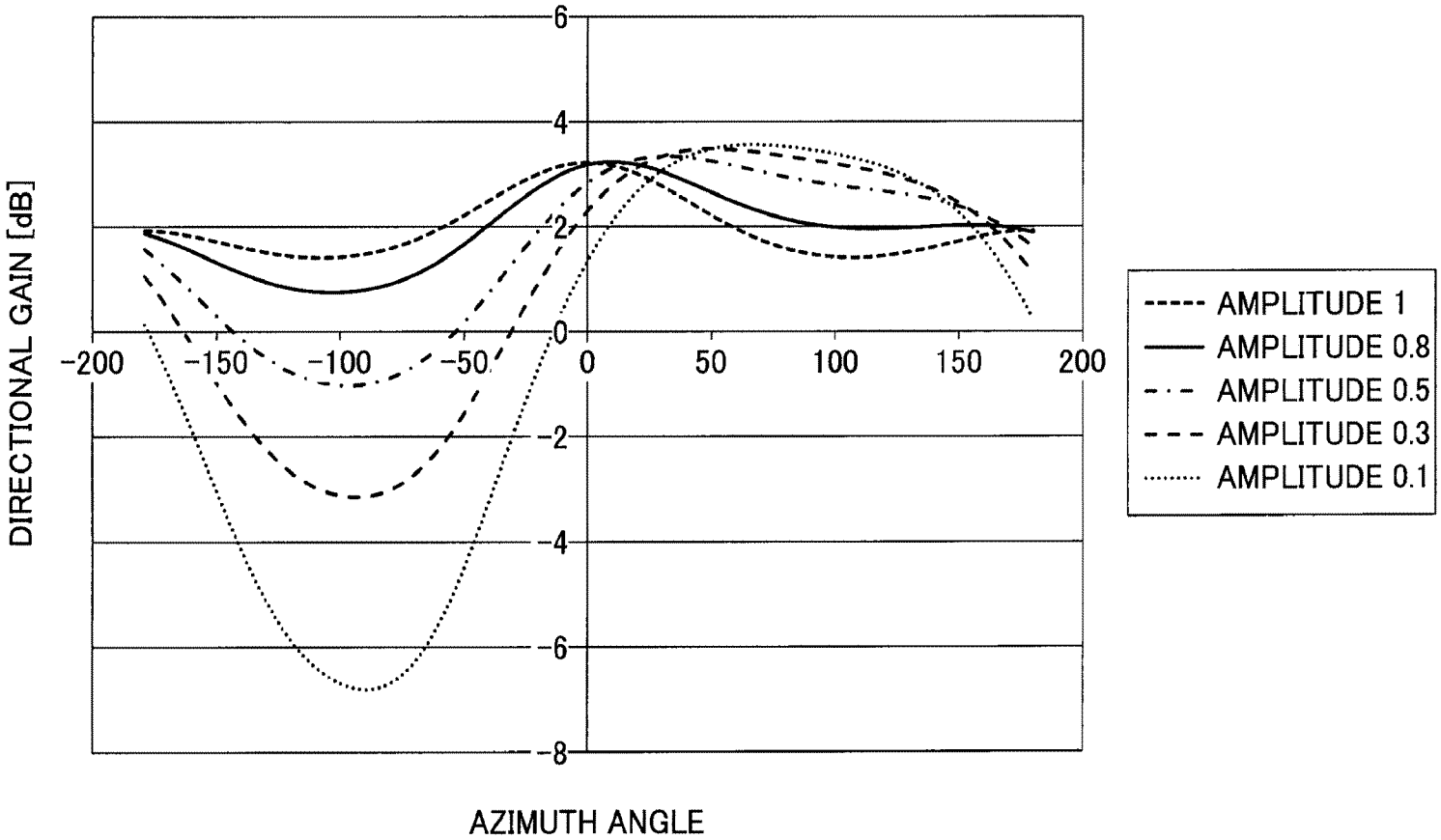
FIG. 5 is a characteristic diagram illustrating an example of directivity of the antenna.

The antenna 1 also has an antenna characteristic such that the direction of the maximum combined gain obtained by combining the antenna element 30 and the antenna element 40 can be varied by differentiating the amplitude of the signal flowing through the feeding point 38 from the amplitude of the signal flowing through the feeding point 48. For example, for a case where it is designed so that the resonance frequency of the fundamental mode of the antenna 1 is in the vicinity of 1.8 GHz, the characteristic diagram, such as that of shown in FIG. 5, can be obtained. FIG. 5 is a diagram illustrating the relationship between the directional gain and the azimuth angle for the main polarization (elevation angle θ=90 degrees) at the resonance frequency (which is adjusted to be in the vicinity of 1.8 GHz) of the fundamental mode of the antenna 1.

The elevation angle θ represents, in the YZ-plane that passes through the middle point between the feeding point 38 and the feeding point 48, and the center point of the ground plane 70, an angle formed with respect to the Y-axis direction. The azimuth angle that is the horizontal axis of FIG. 5 represents, in the ZX-plane that passes through the center point of the ground plane 70, an angle formed with respect to the normal direction of the ground plane 70. The directional gain that is the vertical axis of FIG. 5 represents the combined gain of the antenna element 30 and the antenna element 40.

In FIG. 5, each of the amplitude 1, the amplitude 0.8, the amplitude 0.5, the amplitude 0.3, and the amplitude 0.1 represents, for a case where the amplitude of the signal flowing through the feeding point 38 is set to be 1, the magnitude of the amplitude of the signal flowing through the feeding point 48. Additionally, the phase of the signal flowing through the feeding point 38 and the phase of the signal flowing through the feeding point 48 are the same.

As it is apparent from FIG. 5, by differentiating the amplitude of the signal flowing through the feeding point 38 from the amplitude of the signal flowing through the feeding point 48, the direction of the maximum combined gain of the antenna element 30 and the antenna element 40 (the direction in which the value of the directional gain is maximum) is varied. A similar result can be obtained for a case where it is designed so that the resonance frequency matches another frequency included in the UHF band or the SHF band.

Here, the sizes of the components illustrated in FIGS. 2 and 3 at the time of measurement of FIGS. 4 and 5 in units of mm are as follows:

L1: 20.975,
L2: 15.9,
L3: 8.025,
L4: 68.2,
L5: 33.6,
L6: 120,
L7: 38.75,
L8: 60,
conductor width of each the feed elements 37 and 38: 1,
conductor width of each of the radiating elements 31 and 41: 1,
H1: 0.8,
H2: 2.0, and
H3: 1.1.

The relative dielectric constant of each of the substrates 25 and 26 is 3.3, and tan δ=0.003.

Thus, in FIGS. 1 and 2, when the controller 24 selects the MIMO spatial multiplexing mode, as the transmit mode to be applied to the antenna 1, the antenna 1 can be operated as a MIMO antenna with two channels such that the correlation coefficient between the antenna element 30 and the antenna element 40 is small, and that the antenna element 30 and the antenna element 40 can be used independently from each other.

Whereas, when the controller 24 selects the beam forming mode, as the transmit mode to be applied to the antenna 1, the weight control circuits 21 and 22 adjust the directivity of the antenna 1 to be a pattern that matches the transmission by the beam forming mode. By adjusting the ratio between the amplitudes of the signals flowing through the feeding points 38 and 48 by the weight control circuits 21 and 22, the direction of the maximum combined gain obtained by combining the antenna element 30 and the antenna element 40 can be varied. Thus, the antenna directivity control system 10 can operate the antenna 1, as a single variable directivity antenna that uses the antenna element 30 and the antenna element 40.

When the weight controller 24 selects the beam forming mode, as the transmit mode to be applied to the antenna 1, the weight control circuits 21 and 22 adjust, for example, the amplitude of the signal flowing through the feeding point 48 to be greater or smaller, while fixing the amplitude of the signal flowing through the feeding point 38. However, the weight control circuits 21 and 22 may adjust the amplitude of the signal flowing through the feeding point 38 to be greater or smaller, while fixing the amplitude of the signal flowing through the feeding point 48; or the weight control circuits 21 and 22 may simultaneously adjust the amplitude of the signal flowing through the feeding point 38 and the amplitude of the signal flowing through the feeding point 48 to be greater or smaller.

When the controller 24 selects the beam forming mode, as the transmit mode to be applied to the antenna 1, the weight control circuits 21 and 22 adjust, for example, the amplitudes of the signals flowing through the feeding points 38 and 48, while controlling the phases of the signals flowing through the feeding points 38 and 48 to be the same. However, the weight control circuits 21 and 22 may adjust the amplitudes of the signals flowing through the feeding points 38 and 48, without controlling the phases of the signals flowing through the feeding points 38 and 48, so as to leave these phases as different phases.

<Configuration of Antenna 2>

Figure 6:
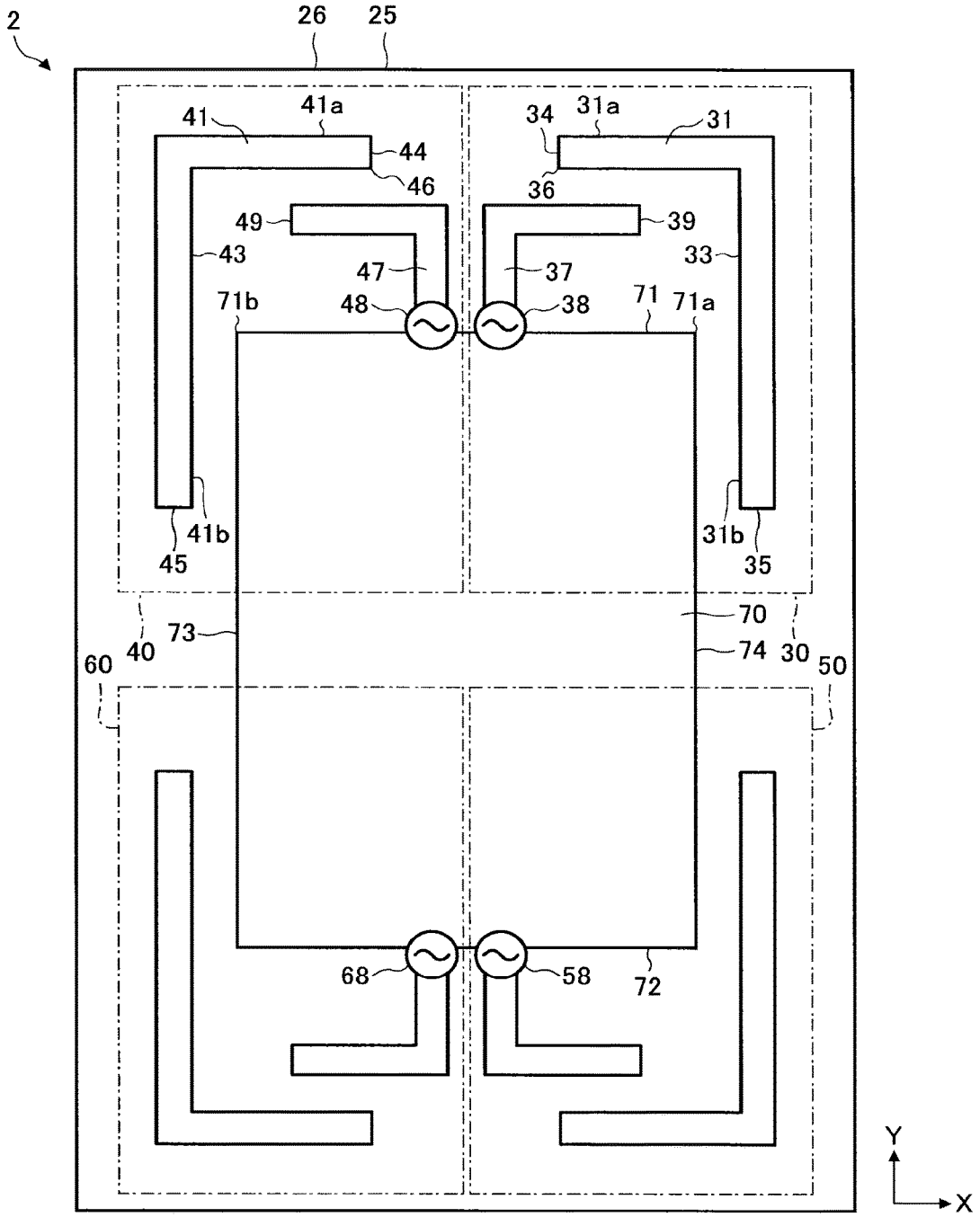
FIG. 6 is a plan view illustrating an example of the antenna including the plurality of antenna elements, where the feeding points for the plurality of antenna elements are mutually different.

FIG. 6 is a plan view schematically illustrating an example of a configuration of an antenna 2 according to another embodiment of the present invention. The antenna 2 is an example of the antenna 13 illustrated in FIG. 1. The description of the configurations that are the same as those of the above-described embodiment is omitted. The antenna 2 includes the ground plane 70; and four antenna elements 30, 40, 50, and 60.

The antenna 2 differs from the antenna 1 of FIG. 2 in a point that the antenna elements 50 and 60 having the same configurations as those of the antenna elements 30 and 40 are arranged line symmetrically with respect to the ground plane 70.

The antenna 2 has an antenna characteristic such that the correlation coefficient among the antenna elements 30, the antenna element 40, the antenna element 50, and the antenna element 60 becomes small at the resonance frequency. In addition, the antenna 2 has an antenna characteristic such that by differentiating the amplitude of the signal flowing through the feeding point 38 from the amplitude of the signal flowing through the feeding point 48, the direction of the maximum combined gain obtained by combining the antenna element 30 and the antenna 40 can be varied. Furthermore, the antenna 2 has an antenna characteristic such that by differentiating the amplitude of the signal flowing through a feeding point 58 from the amplitude of the signal flowing through a feeding point 68, the direction of the maximum combined gain obtained by combining the antenna element 50 and the antenna 60 can be varied.

Consequently, the antenna directivity control system 10 can operate the antenna 2 as a MIMO antenna with four channels where the antenna elements 30, 40, 50, and 60 are used independently from each other. Additionally, the antenna directivity control system 10 can operate the antenna 2 as two variable directivity antennas including a first variable directivity antenna that uses the antenna element 30 and the antenna element 40; and a second variable directivity antenna that uses the antenna element 50 and the antenna element 60.

EXAMPLE

Figure 7:
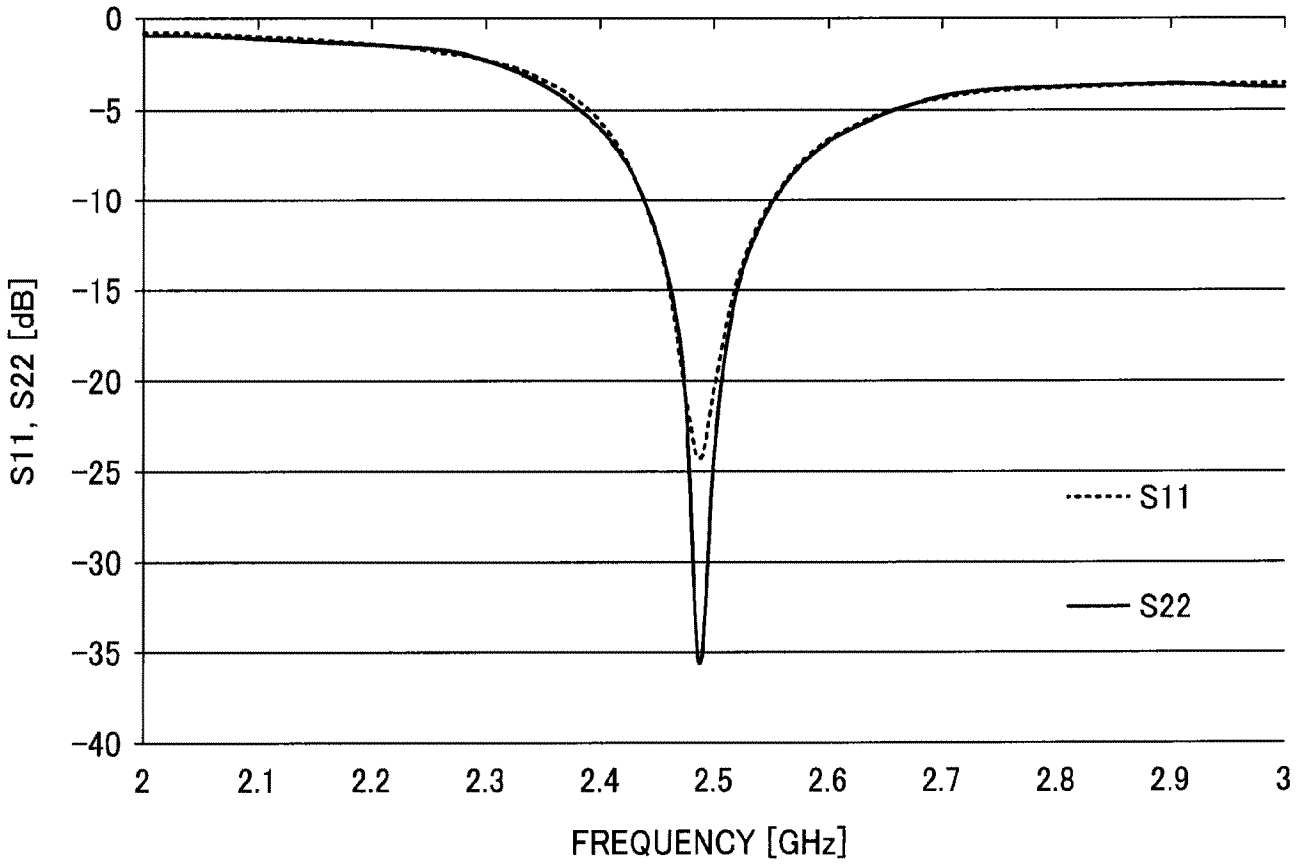
FIG. 7 is a characteristic diagram illustrating an example of an experimental result of S parameters of the antenna.
Figure 8:
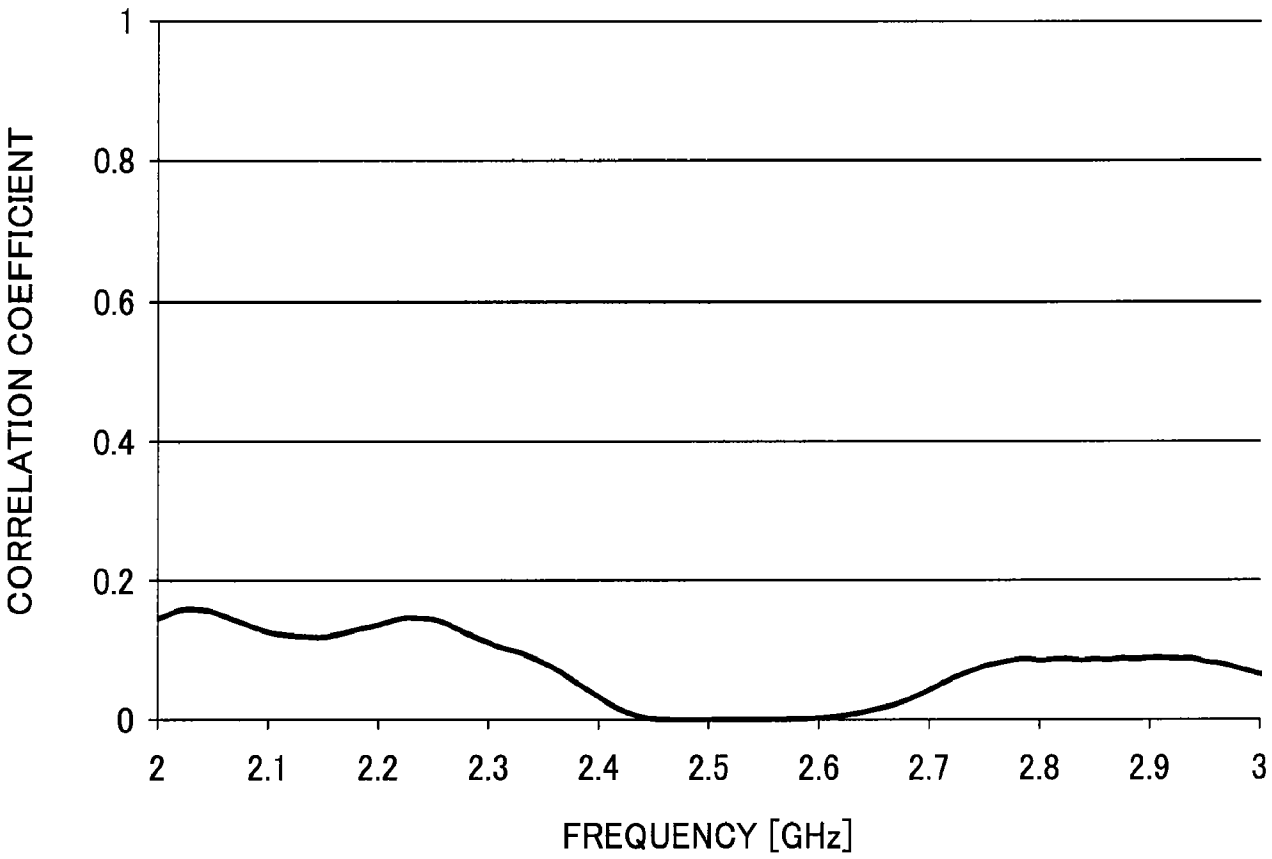
FIG. 8 is a characteristic diagram illustrating an example of an experimental result of the correlation coefficient of the antenna.

Next, results of an experiment are shown by referring to FIGS. 7 and 8, where the antenna 1 was actually produced, and the experiment was conducted as to whether the correlation coefficient between the antenna element 30 and the antenna element 40 was lowered at the resonance frequency.

Here, the sizes of the components illustrated in FIGS. 2 and 3 at the time of FIGS. 7 and 8 in units of mm were as follows:

L1: 14,
L2: 11,
L3: 5.7,
L4: 50,
L5: 25,
L6: 120,
L7: 28.5,
L8: 60,
conductor width of each the feed elements 37 and 38: 0.5,
conductor width of each of the radiating elements 31 and 41: 0.5,
the shortest distance between the end portion 34 of the radiating element 31 and the end portion 44 of the radiating element 41: 4,
the shortest distance between the center of the conductor width of the feed element 37 and the center of the conductor width of the feed element 47 in the X-axis direction: 4
H1: 0.8,
H2: 2.0, and
H3: 1.0.

The relative dielectric constant of each of the substrates 25 and 26 was 3.3, and tan $\delta$=0.003. The shapes of the antenna element 30 and the antenna element 40 were line symmetric with respect to the YZ-plane passing through the feeding point 38 and the feeding point 48.

FIG. 7 shows an example of the results of measuring S11 and S12, which represents the reflection coefficients at the two antenna ports of the antenna 1 in the experiment, and the antenna 1 in the experiment had a resonance frequency of approximately 2.5 GHz. FIG. 8 shows an example of the correlation coefficient that was calculated from the S parameters between the two antenna ports of the antenna 1 in the experiment, in accordance with the above-described formula; and it is shown that the correlation coefficient between the antenna element 30 and the antenna element 40 was decreased close to zero in the vicinity of 2.5 GHz. Namely, the antenna 1 favorably functions as a MIMO antenna that operates in the vicinity of approximately 2.5 GHz.

The antenna directivity control system is described above by the embodiments; however, the present invention is not limited to the above-described embodiments. Various modifications and improvements, such as a combination with a part or all of another embodiment or replacement, may be made within the scope of the present invention.

What is claimed is:

1. An antenna directivity control system, comprising:

an antenna including a plurality of antenna elements having mutually different feeding points; and a controller comprising circuitry configured to control weight for each of the antenna elements, wherein each of the antenna elements includes a feed element connected to a respective one of the feeding points, and a radiating element configured to establish electromagnetic field coupling with the feed element such that the radiating element functions as a radiating conductor upon power being fed by establishing the electromagnetic field coupling with the feed element, the circuitry of the controller is configured to control a directivity of the antenna by adjusting an amplitude of a signal at each of the feeding points without controlling a phase of the signal, and each of the antenna elements is formed such that a distance in which the feed element and the radiating element are extended in parallel while separated by a shortest distance is less than or equal to ⅜ of a length of the radiating element.

2. The antenna directivity control system according to claim 1, wherein the circuitry of the controller is configured to select, as a transmit mode to be applied to the antenna, a MIMO spatial multiplexing mode or a beam forming mode, and upon detecting that the transmit mode is the beam forming mode, the circuitry of the controller is configured to control the directivity of the antenna.

3. The antenna directivity control system according to claim 2, wherein the circuitry of the controller is configured to select the transmit mode, depending on a radio wave environment in a vicinity of the plurality of antenna elements.

4. The antenna directivity control system according to claim 2, wherein each of the antenna elements is formed such that when a wavelength at a resonance frequency of a fundamental mode of the radiating element in vacuum is $\lambda_0$, the shortest distance between the feed element and the radiating element is less than or equal to $0.2\times\lambda_0$.

5. The antenna directivity control system according to claim 1, wherein the circuitry of the controller is configured to adjust the amplitude, while phases of the signals are in-phase.

6. The antenna directivity control system according to claim 1, wherein the feeding points of the plurality of antenna elements are positioned in close proximity to each other.

7. The antenna directivity control system according to claim 1, wherein the plurality of antenna elements is formed in a shape that is line symmetrical.

8. The antenna directivity control system according to claim 1, wherein the plurality of antenna elements is formed such that a ground plane that is a common reference of ground for the feeding points for the plurality of antenna elements is located between radiating elements of the plurality of antenna elements.

9. The antenna directivity control system according to claim 1, wherein each of the antenna elements is formed such that when an electrical length that induces a fundamental mode of a resonance of the feed element is Le37, an electrical length that induces a fundamental mode of a resonance of the radiating element is Le31, and a wavelength on the feed element or the radiating element at the resonance frequency of the fundamental mode of the radiating element is $\lambda$, Le37 is less than or equal to $(3/8)\cdot\lambda$, and Le31 is greater than or equal to $(3/8)\cdot\lambda$ and less than or equal to $(5/8)\cdot\lambda$.

10. The antenna directivity control system according to claim 1, wherein each of the antenna elements is formed such that when a wavelength at a resonance frequency of a fundamental mode of the radiating element in vacuum is $\lambda_0$, a shortest distance between the feed element and the radiating element is less than or equal to $0.2\times\lambda_0$.

11. The antenna directivity control system according to claim 1, wherein the radiating element includes a feeding part positioned such that power is fed to the feeding part from the feed element, and the feeding part is formed at a part of the radiating element other than a part with a lowest impedance at a resonance frequency of a fundamental mode of the radiating element.

12. The antenna directivity control system according to claim 1, wherein the radiating element includes a feeding part positioned such that power is fed to the feeding part from the feed element, and the feeding part is formed at a part of the radiating element such that the part of the radiating element is separated from a part with a lowest impedance at a resonance frequency of a fundamental mode of the radiating element by a distance that is greater than or equal to ⅛ of a total length of the radiating element.

13. The antenna directivity control system according to claim 1, wherein the radiating element includes a feeding part positioned such that power is fed to the feeding part from the feed element, and each of the antenna elements is formed such that when a wavelength at a resonance frequency of a fundamental mode of the radiating element in vacuum is $\lambda_0$, a shortest distance between the feeding part and a ground plane that is a reference of ground of the feeding point is greater than or equal to $0.0034\lambda_0$ and less than or equal to $0.021\lambda_0$.

14. A radio device, comprising:

an antenna directivity control system comprising an antenna including a plurality of antenna elements having mutually different feeding points; and a controller comprising circuitry configured to control weight for each of the antenna elements, wherein each of the antenna elements includes a feed element connected to a respective one of the feeding points, and a radiating element configured to establish electromagnetic field coupling with the feed element such that the radiating element functions as a radiating conductor upon power being fed by establishing the electromagnetic field coupling with the feed element, the circuitry of the controller is configured to control a directivity of the antenna by adjusting an amplitude of a signal at each of the feeding points without controlling a phase of the signal, and each of the antenna elements is formed such that a distance in which the feed element and the radiating element are extended in parallel while separated by a shortest distance is less than or equal to ⅜ of a length of the radiating element.

15. The radio device according to claim 14, wherein the circuitry of the controller is configured to select, as a transmit mode to be applied to the antenna, a MIMO spatial multiplexing mode or a beam forming mode, and upon detecting that the transmit mode is the beam forming mode, the circuitry of the controller is configured to control the directivity of the antenna.

16. The radio device according to claim 14, wherein the circuitry of the controller is configured to adjust the amplitude, while phases of the signals are in-phase.

17. The radio device according to claim 14, wherein the feeding points of the plurality of antenna elements are positioned in close proximity to each other.

18. The radio device according to claim 14, wherein the plurality of antenna elements is formed in a shape that is line symmetrical.

19. The radio device according to claim 14, wherein the plurality of antenna elements is formed such that a ground plane that is a common reference of ground for the feeding points for the plurality of antenna elements is located between radiating elements of the plurality of antenna elements.

* * * * *